US008865990B2

(12) United States Patent
Minamitaka

(10) Patent No.: US 8,865,990 B2
(45) Date of Patent: Oct. 21, 2014

(54) MUSICAL PERFORMANCE EVALUATING DEVICE, MUSICAL PERFORMANCE EVALUATING METHOD AND STORAGE MEDIUM

(75) Inventor: Junichi Minamitaka, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 242 days.

(21) Appl. No.: 13/618,590

(22) Filed: Sep. 14, 2012

(65) Prior Publication Data

US 2013/0074679 A1 Mar. 28, 2013

(30) Foreign Application Priority Data

Sep. 22, 2011 (JP) ..... 2011-207494

(51) Int. Cl.
*A63H 5/00* (2006.01)
*G10H 1/00* (2006.01)

(52) U.S. Cl.
CPC ..... *G10H 1/0008* (2013.01); *G10H 2210/091* (2013.01); *G10H 2220/151* (2013.01)
USPC ..... 84/609

(58) Field of Classification Search
CPC ..... G10H 1/0008; G10H 2220/151; G10H 2210/091
USPC ..... 84/609
See application file for complete search history.

(56) References Cited

U.S. PATENT DOCUMENTS

| | | | | |
|---|---|---|---|---|
| 8,536,436 | B2 * | 9/2013 | Moreno | 84/470 R |
| 2001/0029830 | A1 * | 10/2001 | Rosen | 84/478 |
| 2004/0123726 | A1 * | 7/2004 | Kato et al. | 84/609 |
| 2006/0009979 | A1 * | 1/2006 | McHale et al. | 704/270 |

FOREIGN PATENT DOCUMENTS

| | | | |
|---|---|---|---|
| JP | 2008-242131 | A | 10/2008 |
| TW | M364252 | U | 9/2009 |

OTHER PUBLICATIONS

Taiwanese Office Action dated Apr. 7, 2014 in counterpart Taiwanese Application No. 101134595.

* cited by examiner

*Primary Examiner* — Jianchun Qin
(74) *Attorney, Agent, or Firm* — Holtz, Holtz, Goodman & Chick PC

(57) ABSTRACT

In the present invention, a CPU identifies musical notation data to which music playing data corresponds, and determines whether the musical notation data has been played using a right-hand, a left-hand, or both hands. When the pitch of the identified musical notation data and the pitch of the music playing data match, the CPU sets a clear flag in the identified musical notation data to "1" to indicate that the note has been correctly played. Then, the CPU extracts the number of occurrences and the number of times cleared for each musical performance technique type, and acquires an achievement level based on the difficulty level of the song by accumulating achievement levels for each musical performance technique type which are calculated based on their accuracy rates acquired from the extracted number of occurrences and number of times cleared and difficulty levels according to their types.

6 Claims, 9 Drawing Sheets

MUSICAL PERFORMANCE EVALUATING DEVICE, MUSICAL PERFORMANCE EVALUATING METHOD AND STORAGE MEDIUM

CROSS-REFERENCE TO RELATED APPLICATION

This application is based upon and claims the benefit of priority from the prior Japanese Patent Application No. 2011-207494, filed Sep. 22, 2011, the entire contents of which is incorporated herein by reference.

BACKGROUND OF THE INVENTION

1. Field of the Invention

The present invention relates to a musical performance evaluating device, a musical performance evaluating method and a storage medium suitable for use in an electronic musical instrument.

2. Description of the Related Art

A device is known that evaluates the playing skills of a user (instrument player) by comparing the musical notation data of a practice song serving as a model with music playing data generated based on the practice song being played. As this type of technology, for example, Japanese Patent Application Laid-open (Kokai) Publication No. 2008-242131 discloses a technology for calculating accuracy rate based on the number of correctly played notes by comparing inputted music playing data and test data corresponding to a model performance, and evaluating the playing skills of the user from the calculated accuracy rate.

However, all it does is to calculate accuracy rate based on the number of correctly played notes and evaluates the playing skills of the user based on the calculated accuracy rate. Accordingly, the technology disclosed in Japanese Patent Application Laid-open (Kokai) Publication. No. 2008-242131 has a problem in that achievement levels indicating the degree of improvement in the user's playing skills cannot be evaluated taking into consideration the difficulty of the song.

SUMMARY OF THE INVENTION

The present invention has been conceived in light of the above-described problem. An object of the present invention is to provide a musical performance evaluating device and a program by which achievement levels indicating the degree of improvement in the user's playing skills can be evaluated taking into consideration the difficulty of the song.

In order to achieve the above-described object, in accordance with one aspect of the present invention, there is provided a musical performance evaluating device comprising a memory which stores a plurality of musical notation data that respectively express each note constituting a song and include a musical performance technique type and an identification flag; an identifying section which identifies musical notation data of a note corresponding to music playing data played and inputted, from the plurality of musical notation data stored in the memory; a flag setting section which sets the identification flag in the identified musical notation data to a flag value indicating that the note has been correctly played, when a pitch of the identified musical notation data of the note and a pitch of the music playing data match; an accuracy rate calculating section which calculates an accuracy rate for each musical performance technique type from number of occurrences and number of times a note has been correctly played for each musical performance technique type which are extracted based on the musical performance technique type and the identification flag included in each of the plurality of musical notation data stored in the memory; and an achievement level acquiring section which acquires an achievement level based on a difficulty level of the song by accumulating achievement levels for each musical performance technique type which are acquired based on the calculated accuracy rate for each musical performance technique type and a difficulty level according to the musical performance technique type.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment of the present invention will hereinafter be described with reference to the drawings.

A. Structure

Figure 1:
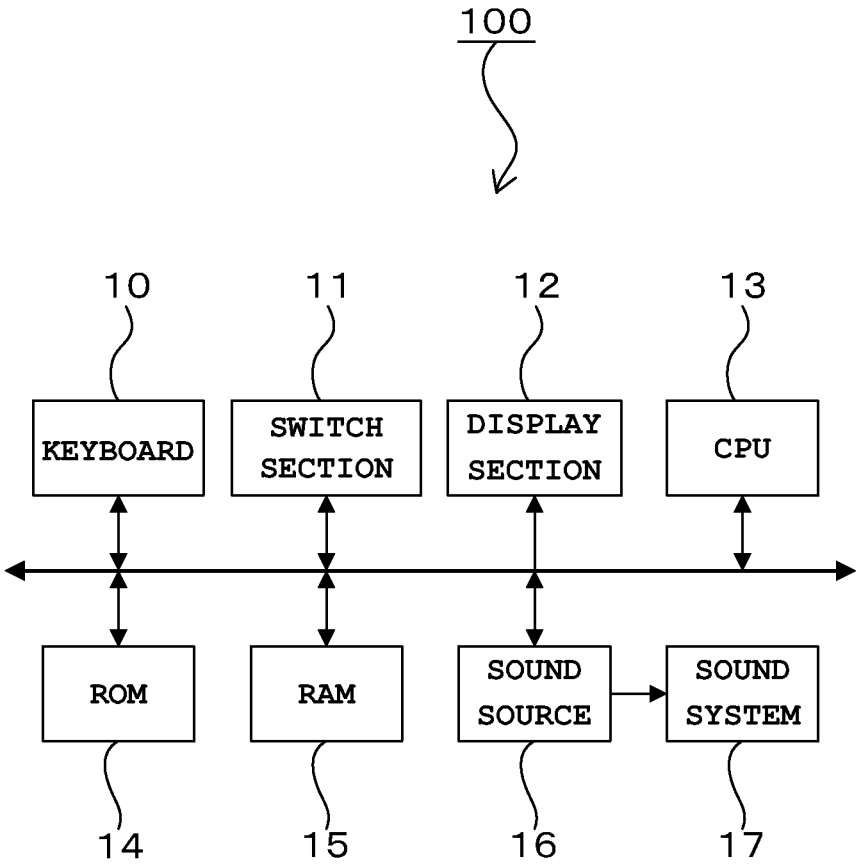
FIG. 1 is a block diagram showing the structure of a musical performance evaluating device 100 according to an embodiment.

FIG. 1 is a block diagram showing the structure of a musical performance evaluating device 100 according to the embodiment of the present invention. A keyboard 10 in FIG. 1 generates musical performance information including a key-ON/key-OFF event, a key number, velocity, and the like based on a key depression and release operation in the playing and inputting of music (musical performance). A switch section 11 of FIG. 1 has various operation switches arranged on a device panel, and generates a switch event corresponding to the type of a switch operated by the user. The main switches provided in the switch section 11 are, for example, a power supply switch for turning ON and OFF the power, a song selection switch for selecting song data that serves as a model (model performance), and an end switch for giving an instruction to end operation.

A display section 12 in FIG. 1 includes a liquid crystal display (LCD) panel or the like, and displays the musical score of song data to be played and inputted, musical performance evaluation results generated when a musical performance is completed, and the operational status and the setting status of the musical performance evaluating device 100, based on display control signals supplied from a central processing unit (CPU) (identifying section, flag setting section, accuracy rate calculating section, achievement level acquiring section, and achievement level correcting section) 13. The CPU 13 converts musical performance information, which is generated by the keyboard 10 in response to the playing and inputting of music, into musical instrument digital interface (MIDI)-format music playing data (such as note-ON/note-OFF), and gives an instruction to produce musical sound by supplying the music playing data to a sound source 16. Also, the CPU 13 evaluates the playing skills of the user based on a comparison of music playing data and musical notation data constituting song data serving as a model (model performance). The characteristic processing operations of the CPU 13 related to the scope of the present invention will be described later in detail.

A read-only memory (ROM) 14 in FIG. 1 stores various control programs to be loaded into the CPU 13. These various control programs are used for corresponding point identification processing, distance calculation processing, dynamic programming (DP) matching processing, musical performance judgment processing, achievement level calculation processing and the like constituting the main routine described hereafter, A random access memory (RAM) 15 of FIG. 1 includes a work area, a music playing data area, and a song data area. The work area of the RAM 15 temporarily stores various register and flag data that are used by the CPU 13 for processing. This area includes a difficulty level table iFTCost in which difficulty levels are registered in association with the types of musical performance techniques. The purpose of the difficulty level table iFTCost will be described later.

The music playing data area of the RAM 15 stores a plurality of music playing data of music playing sounds generated by the CPU 13 in response to the playing and inputting of music. The song data area of the RAM 15 stores song data serving as a model (model performance) for a plurality of songs. This song data is composed of musical notation data expressing a plurality of musical notes forming a song, which is divided into a right-hand part to be played by the right hand, a left-hand part to be played by the left-hand, and a left-hand and right-hand part to be played by both hands.

A single piece of musical notation data is composed of iTime, iGate, iPit, iTech, and iClear, of which iTime indicates sound-generation time, iGate indicates sound length, iPit indicates pitch, and iVel indicates velocity (sound volume) iTech is a value expressing the type of musical performance technique. The type of musical performance technique herein refers to the type of finger movement, such as "cross-over" and "pass-under". Negative values indicate that the note does not require musical performance technique, and values zero or greater indicate the types of musical performance techniques iTech is hereinafter referred to as musical performance technique type. iClear is a flag indicating whether or not the corresponding note has been correctly played following the model "1" indicates that the note has been correctly played following the model, and "0" indicates that the note has not been correctly played. iClear is hereinafter referred to as a clear flag iClear.

The sound source 16 is configured by a known waveform memory readout system, and generates and outputs musical sound data based on music playing data supplied by the CPU 13. A sound system 17 in FIG. 1 converts musical sound data outputted from the sound source 16 to analog-format musical sound signals, and after performing filtering to remove unwanted noise and the like from the musical sound signals, amplifies the level, and emits the sound from a speaker.

B. Operations

Next, operations of the musical performance evaluating device 100 structured as above will be described with reference to FIG. 2 to FIG. 9. Specifically, operations in the main routine, the corresponding point identification processing, the musical performance judgment processing, and the achievement level calculation processing that are performed by the CPU 13 will hereinafter be described, respectively. Note that the corresponding point identification processing includes the distance calculation processing and the DP matching processing.

(1) Operations in the Main Routine

Figure 2:
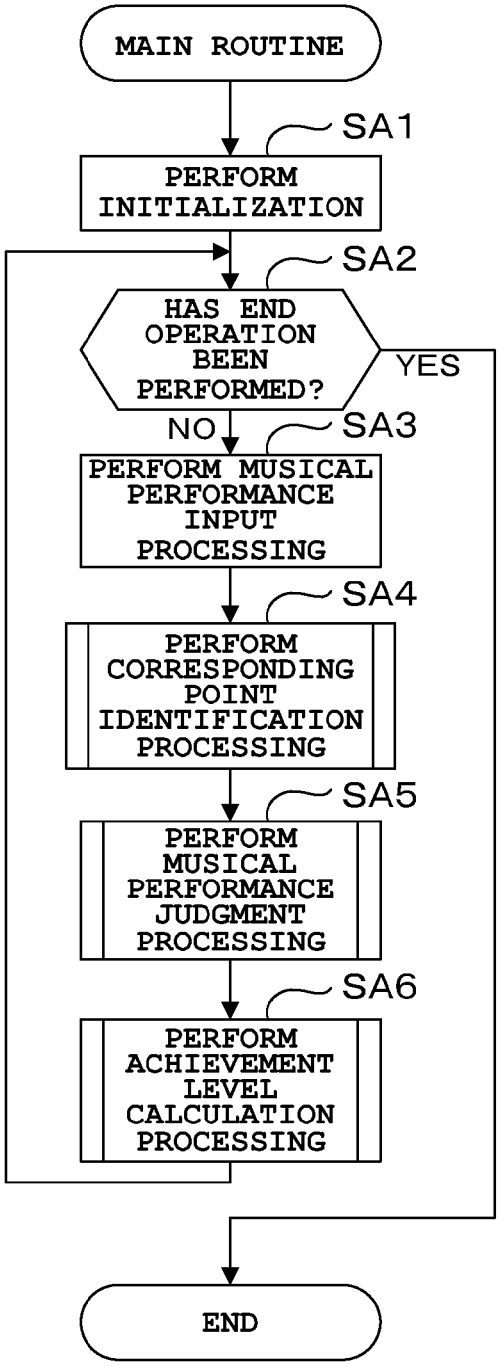
FIG. 2 is a flowchart of operations in the main routine.

FIG. 2 is a flowchart of operations in the main routine. When the musical performance evaluating device 100 is turned ON, the CPU 13 runs the main routine shown in FIG. 2. First, the CPU 13 proceeds to Step SA1 and performs initialization to initialize each section of the musical performance evaluating device 100. When the initialization is completed, the CPU 13 proceeds to Step SA2 and judges whether or not an end operation has been performed. When judged that an end operation has been performed, the judgment result is "YES", and therefore the CPU 13 ends the main routine. Conversely, when judged that an end operation has not been performed, the judgment result is "NO", and therefore the CPU 13 proceeds to Step SA3.

At Step SA3, the CPU 13 performs musical performance input processing for storing music playing data which has been generated by the CPU 13 in response to the playing and inputting of music in the music playing data area of the RAM 15. In the musical performance input processing, song data selected by the operation of the song selection switch is set as a practice piece, the music score of the song data is displayed on the display section 12, and the user plays and inputs the song while viewing the music score.

Next, at Step SA4, the CPU 13 performs the corresponding point identification processing for identifying the musical notation data in the song data serving as a model (mode/performance) to which the music playing data generated by the song being played and inputted by the user corresponds, and determining whether the corresponding musical notation data is a right-hand part, a left-hand part, or a left-hand and right-hand part.

Next, at Step SA5, the CPU 13 performs the musical performance judgment processing for judging whether or not the note of the musical notation data identified at above-described Step SA4 has been correctly played by comparing the pitch iPit of the musical notation data with the pitch of the music playing data, and setting the clear flag iClear of the correctly played musical notation data to "1".

Then, at Step SA6, the CPU 13 performs the achievement level calculation processing. As described hereafter, in the achievement level calculation processing, the CPU 13 extracts the number of occurrences and the number of times cleared (the number of times musical notation data is correctly played) for each type of musical performance technique from the musical performance technique type iTech included in all musical notation data in the song data; calculates an achievement level for each type of musical performance technique by multiplying an accuracy rate (number of times cleared/number of occurrences) for each type of musical performance technique acquired from the extracted number of occurrences and the extracted number of times cleared by a difficulty level according to the type of musical performance technique; accumulates each calculated achievement level; and thereby acquires an achievement level "a" based on the difficulty level of the song. Then, the CPU 13 returns to above-described Step SA2, and repeatedly performs Step SA2 to Step SA6 until an and operation is performed.

(2) Operations in the Corresponding Point Identification Processing

Figure 3:
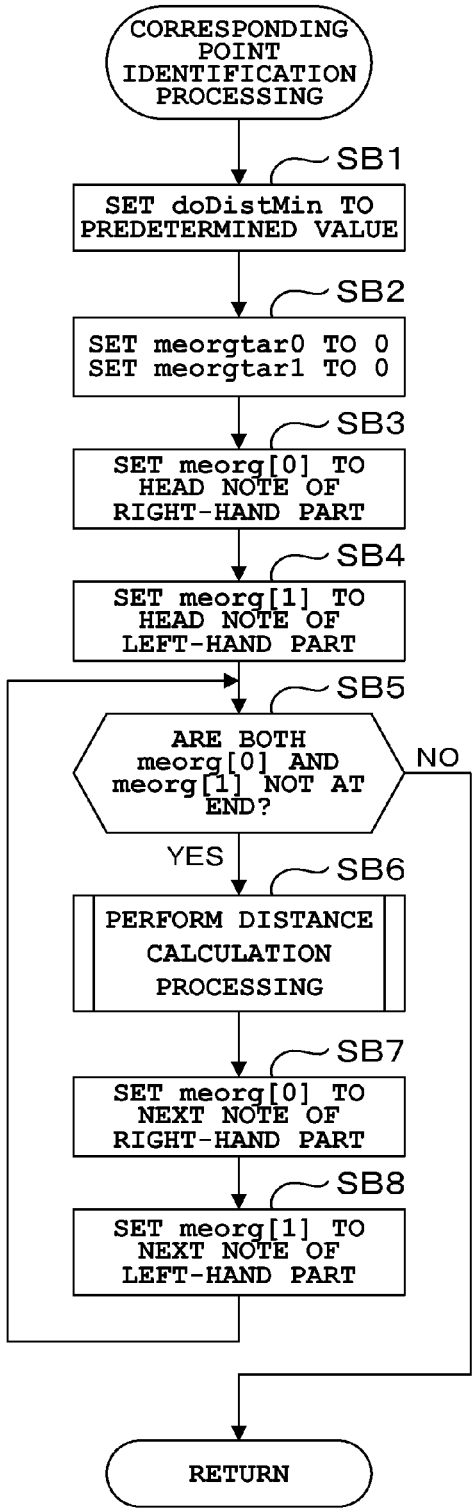
FIG. 3 is a flowchart of operations in corresponding point identification processing.

Next, operations in the corresponding point identification processing will be described with reference to FIG. 3. When the corresponding point identification processing is started at Step SA4 (see FIG. 2) of the main routine, the CPU 13 proceeds to Step SB1 shown in FIG. 3, and stores a predetermined value serving as an initial value in a register doDistMin. The purpose of the initial value stored in the register doDistMin will be described hereafter.

Next, at Step SB2, the CPU 13 resets a pointer meorgtar0 and a pointer meorgtar1 to "1". The pointer meorgtar0 herein is a pointer that specifies musical notation data corresponding to music playing data generated by the playing and inputting of music by the user, from among the musical notation data of the right-hand part in the song data. Similarly, the pointer meorgtar1 is a pointer that specifies musical notation data corresponding to music playing data generated by the playing and inputting of music by the user, from as the musical notation data of the left-hand part in the song data.

Next, at Step SB3 to Step SB4, the CPU 13 stores in a pointer meorg[0] an address value specifying a head note (note at the head of musical notation data) within the musical notation data of the right-hand part in the song data. In addition, the CPU 13 stores in a pointer meorg[1] an address value specifying a head note (note at the head of musical notation data) within the musical notation data of the left-hand part in the song data. The CPU 13 then proceeds to Step SB5 and judges whether or not both pointers meorg[0] and meorg[1] are at the end, or in other words, whether or not the search of a corresponding point has been performed to the end of the song.

When judged that the search of a corresponding point has not been performed to the end of the song, the judgment result at Step SB5 is "YES" and therefore the CPU 13 proceeds to Step SB6. At Step SB6 to Step SB8, until the end of the song is reached, the CPU 13 repeatedly performs the distance calculation processing of Step SB6 such that the processing is performed every time the pointers meorg[0] and meorg[1] are forwarded. Then, when judged that the search of a corresponding point has been performed to the end of the song, the judgment result at Step SB5 is "NO" and therefore the CPU 13 ends the corresponding point identification processing.

As described hereafter, in the distance calculation processing at Step SB6, the CPU 13 performs known DP matching on the music playing data generated by the playing and inputting of music by the user for all musical notation data (the right-hand part, the left-hand part, and the left-hand and right-hand part) in the song data; calculates a distance (a distance for the right-hand part, a distance for the left-hand part, and a distance for the left-hand and right-hand part) equivalent to the degree of similarity; and identifies the musical notation data of a part that has the shortest distance among the calculated distances and therefore has the greatest degree of similarity, as a point corresponding to the music playing data.

(3) Operations in the Distance Calculation Processing

Figure 4:
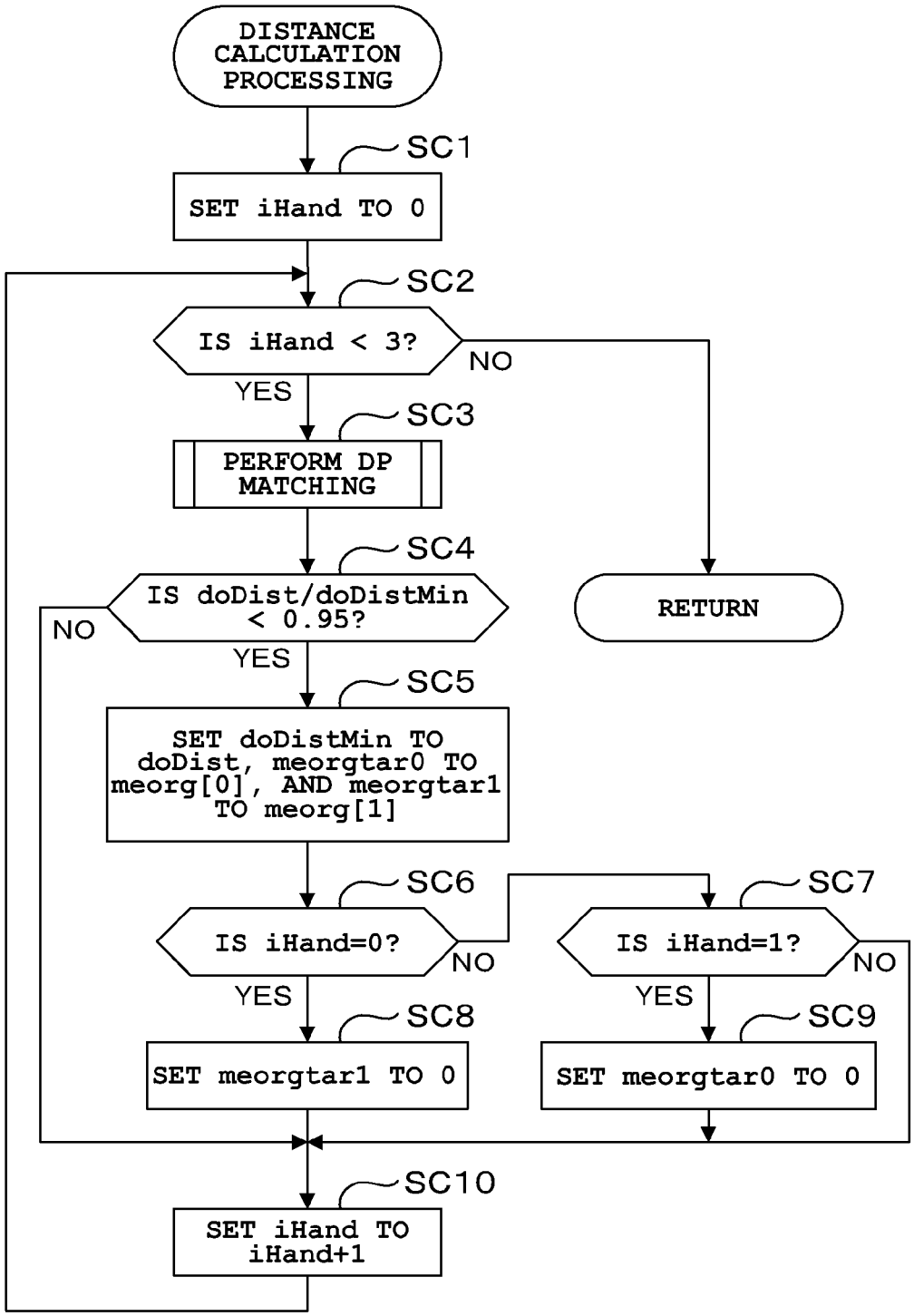
FIG. 4 is a flowchart of operations in distance calculation processing.

Next, operations in the distance calculation processing will be described with reference to FIG. 4. When the distance calculation processing is started at Step SB6 (see FIG. 3) of the above-described corresponding point identification processing, the CPU 13 proceeds to Step SC1 shown in FIG. 4 and stores "0" in a register iHand. The value of the register iHand specifies a part in the song data. Specifically, "1" specifies the right-hand part in the song data and "1" specifies the left-hand part in the song data "2" the left-and right-hand part in the song data. The value of the register iHand is hereinafter referred to as part specification data iHand.

Next, at Step SC2, the CPU 13 judges whether or not the part specification data iHand is less than "3", or in other words, whether or not the distance calculation has been completed for all the parts. When judged that the part specification data iHand is less than "3" and the distance calculation has not been completed for all the parts, the judgment result is "YES" and therefore the CPU 13 performs the DP matching processing at Step SC3. In the DP matching processing, the CPU 13 acquires a distance doDist equivalent to the degree of similarity to all musical notation data (the right-hand part, the left-hand part, and the left-hand and right-hand part) in the song data for the music playing data generated by the playing and inputting of music by the user, as described hereafter.

Next, at Step SC4, the CPU 13 judges whether or not the distance doDist currently acquired in the DP matching processing at Step SC3 is less than 95% of the preceding acquired distance doDistMin (in the initial operation, the predetermined value stored at Step SB1 is used), or other words, whether or not the shortest distance has been updated. When judged that the shortest distance has not been updated, the judgment result is "NO" and therefore the CPU 13 proceeds to Step SC10 described hereafter.

Conversely, when judged that the currently acquired distance doDist is less than 95% of the preceding acquired distance doDistMin and the shortest distance has been updated, the judgment result at Step SC4 is "YES" and therefore the CPU 13 proceeds to Step SC5. At Step SC5, the CPU 13 updates the distance doDistMin with the distance doDist. In addition, at Step SC5, the CPU 13 sets the value of the pointer meorg[0] in the pointer meorgtar0 and the value of the pointer meorg[1] in the pointer meorgtar1.

Then, the CPU 13 proceeds to Step SC6 and judges whether or not the hand specification data iHand is "0", or in other words, whether or not distance calculation is performed on the right-hand part. When judged that distance calculation is performed on the right-hand part, the judgment result is "YES", and therefore the CPU 13 proceeds to Step SC8 and resets the pointer meorgtar1 to "0". At subsequent Step SC10, the CPU 13 increments and forwards the part specification data iHand, and then returns to the above-described processing at Step SC2.

Conversely, when judged that the part specification data iHand is not "0", or in other words, distance calculation is not performed on the right-hand part, the judgment result at Step SC6 is "NO", and therefore the CPU 13 proceeds to Step SC7 and judges whether or not the part specification data iHand is "1", or in other words, whether or not distance calculation is performed on the left-hand part. When judged that distance calculation is performed on the left-hand part, the judgment result is "YES", and therefore the CPU 13 proceeds to Step SC9 and resets the pointer meorgtar0 to "0". At subsequent Step SC10, the CPU 13 increments and forwards the part specification data iHand, and then returns to the above-described processing at Step SC2.

On the other hand, when judged that distance calculation is not performed on the left-hand part, or in other words, distance calculation is performed on the left-hand and right-hand part, the judgment result at above-described Step SC7 is "NO", and therefore the CPU 13 proceeds to Step SC10. At Step SC10, the CPU 13 increments and forwards the part specification data iHand, and then returns to the above-described processing at Step SC2. At Step SC2, when judged that the forwarded part specification data iHand is greater than "3", the judgment result at Step SC2 is "NO" and therefore the CPU 13 ends the distance calculation processing.

(4) Operations in the DP Matching Processing

Figure 5:
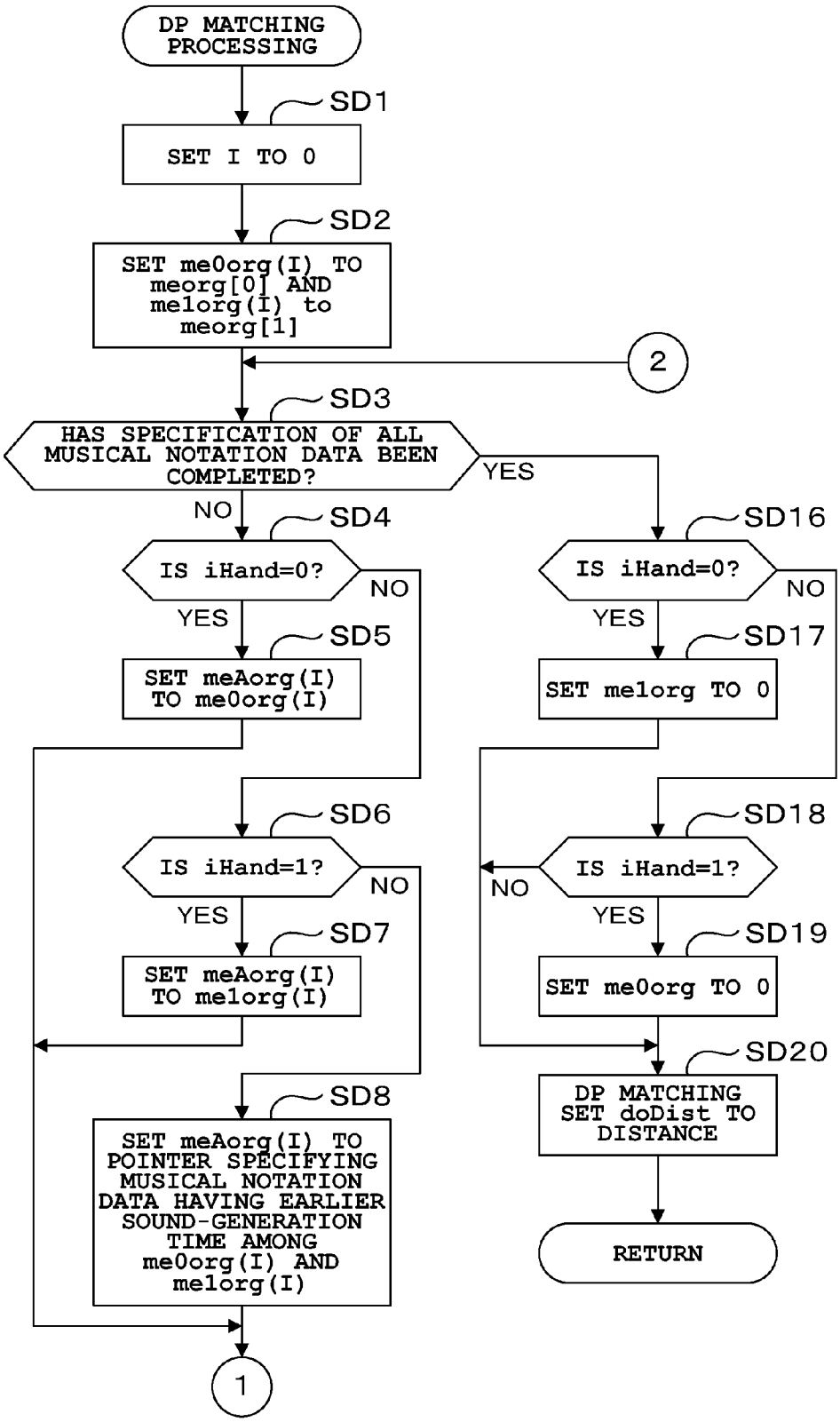
FIG. 5 is a flowchart of operations in PP matching processing.

Next, operations in the DP matching processing will be described with reference to FIG. 5 to FIG. 6. When the DP matching processing is started at Step SC3 (see FIG. 4) of the distance calculation processing, the CPU 13 proceeds to Step SD1 shown in FIG. 5 and resets a pointer I specifying musical notation data to an initial value "0".

Next, at Step SD2, the CPU 13 sets the value of the pointer meorg[0] in a pointer me0org(I) and the value of the pointer meorg[1] in a pointer me1org(I). The pointer meorg[0] herein is a pointer value that specifies the head musical notation data of the right-hand part in the song data, and the pointer meorg [1] herein is a pointer value that specifies the head musical notation data of the left-hand part in the song data.

Then, at Step SD3, the CPU 13 judges whether or not all the musical notation data have been specified based on the forwarding of the pointer I. When judged that not all of the musical notation data have been specified, the judgment result at Step SD3 is "NO" and therefore the CPU 13 proceeds to Step SD4. At Step SD4, the CPU 13 judges whether or not the part specification data iHand is "0", or in other words, whether or not DP matching is performed on the right-hand part. When judged that DP matching is performed on the right-hand part the judgment result at Step SD4 is "YES" and therefore the CPU 13 proceeds to Step SD5. At Step SD5, the CPU 13 sets a pointer meAorg(I) to the pointer me0org(I) and proceeds to Step SD9 (described hereafter) in FIG. 6.

Conversely, when judged that PP matching is not performed on the right-hand part, the judgment result at Step SD4 is "NO" and therefore the CPU 13 proceeds to Step SD6. At Step SD6, the CPU 13 judges whether or not the hand specification data iHand is "1", or in other words, whether or not PP matching is performed on the left-hand part. When judged that DP matching is performed on the left-hand part, the judgment result at Step SD6 is "YES" and therefore the CPU 13 proceeds to Step SD7. At Step SD7, the CPU 13 sets the pointer meAorg(I) to the pointer me1org(I) and proceeds to Step SD9 (described hereafter) in FIG. 6.

On the other hand, when judged that the PP matching is performed on the left-hand and right-hand part, the judgment result at Step SD6 is "NO" and therefore the CPU 13 proceeds to Step SD8. At Step SD8, the CPU 13 compares the sound-generation time iTime of musical notation data specified by the pointer me0org(I) with the sound-generation time iTime of musical notation data specified by the pointer me1org(I), and sets the pointer meAorg(I) to a pointer specifying musical notation data having an earlier sound-generation time. The CPU 13 then proceeds to Step SD9 in FIG. 6.

Figure 6:
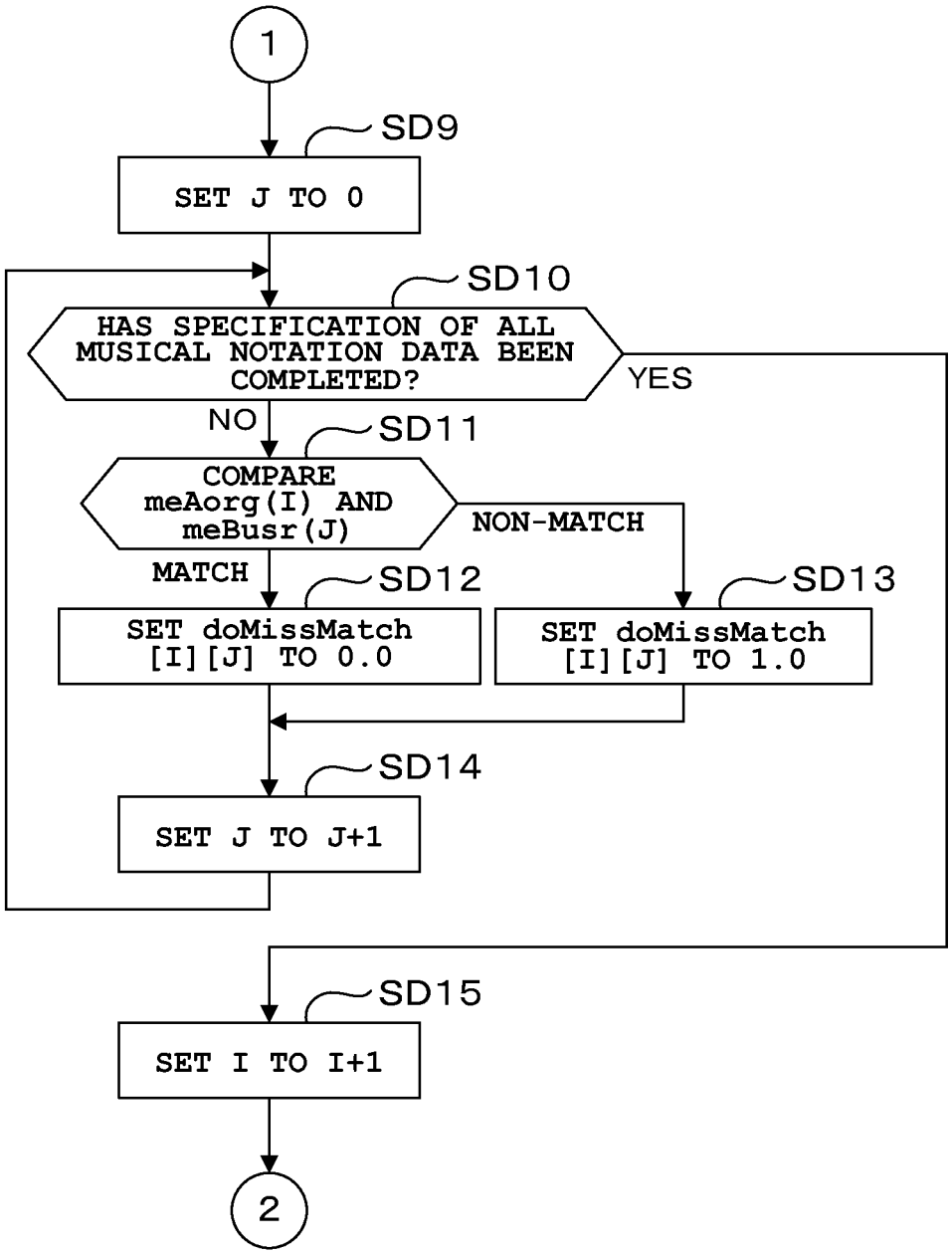
FIG. 6 is a flowchart of operations in the PP matching processing following those in FIG. 5.

At Step SD9 in FIG. 6, the CPU 13 sets a pointer "J" that specifies music playing data to an initial value "0". Next, at Step SD10, the CPU 13 judges whether or not all the music playing data have been specified based on the forwarding of the pointer J. When judged that not all of the music playing data have been specified, the judgment result at Step SD10 is "NO" and therefore the CPU 13 proceeds to Step SD11.

At Step SD11, the CPU 13 compares the pitch iPit of the musical notation data specified by the pointer meAorg(I) with the pitch of music playing data specified by a pointer meBusr (J). When judged that the pitch of the musical notation data and the pitch of the music playing data match, the CPU 13 proceeds to Step SD12 and sets a register doMissMatch[I][J] to a matching value "0.0". Conversely, when judged that the pitch of the musical notation data and the pitch of the music playing data do not match, the CPU 13 proceeds to Step SD13 and sets the register doMissMatch[I][J] to a non-matching value "1.0"

Next, at Step SD14, the CPU 13 increments and forwards the pointer J and returns to above-described Step SD10. Hereafter, the CPU 13 repeats above-described Step SD10 to Step SD14 while forwarding the pointer J, and thereby judges whether the pitch iPit of the musical notation data specified by the pointer meAorg(I) matches or does not match for all the music playing data, and stores the judgment result in a two-dimensional register doMissMatch[I][J] equivalent to a matching/non-matching matrix. When all the music playing data are specified by the forwarding of the pointer J, the judgment result at Step SD10 is "YES" and therefore the CPU 13 proceeds to Step SD15. At Step SD15, the CPU 13 increments and forwards the pointer I, and then returns to above-described Step SD3 (see FIG. 5).

Then, when all the musical notation data are specified by the forwarding of the pointer I, the judgment result at Step SD3 is "YES" and therefore the CPU 13 proceeds to Step SD16. At Step SD16, the CPU 13 judges whether or not the part specification iHand is "0", or in other words, whether DP matching is performed on the right-hand part. When judged that DP matching is performed on the right-hand part, the judgment result at Step SD16 is "YES" and therefore the CPU 13 proceeds to Step SD17. At Step SD17, the CPU 13 resets a pointer me1org to "0" and proceeds to Step SD20.

Conversely, when judged that the part specification data iHand is not "0", or in other words, DP matching is not performed on the right-hand part, the judgment result at Step SD16 is "NO" and therefore the CPU 13 proceeds to Step SD18. At Step SD18, the CPU 13 judges whether or not the part specification data iHand is "1", or in other words, whether or not DP matching is performed on the left-hand part. When judged that DP matching is performed on the left-hand part, the judgment result at Step SD18 is "YES" and therefore the CPU 13 proceeds to Step SD19. At Step SD19, the CPU 13 resets a pointer me0org to "0", and proceeds to Step SD20.

On the other hand, when judged that DP matching is performed on the left-hand and right-hand part, the judgment results at Step SD16 and Step SD18 are "NO" and therefore the CPU 13 proceeds to Step SD20. At Step SD20, the CPU 13 acquires the distance doDist equivalent to the degree of similarity to all the musical notation data (the right-hand part, the left-hand part, and the left-hand and right-hand part) in the song data for the music playing data generated by the playing and inputting of music by the user, by performing known DP matching based on the matching/non-matching matrix stored in the two-dimensional register doMissMatch[I] and [J], and ends the DP matching processing.

(5) Operations in the Musical Performance Judgment Processing

Figure 7:
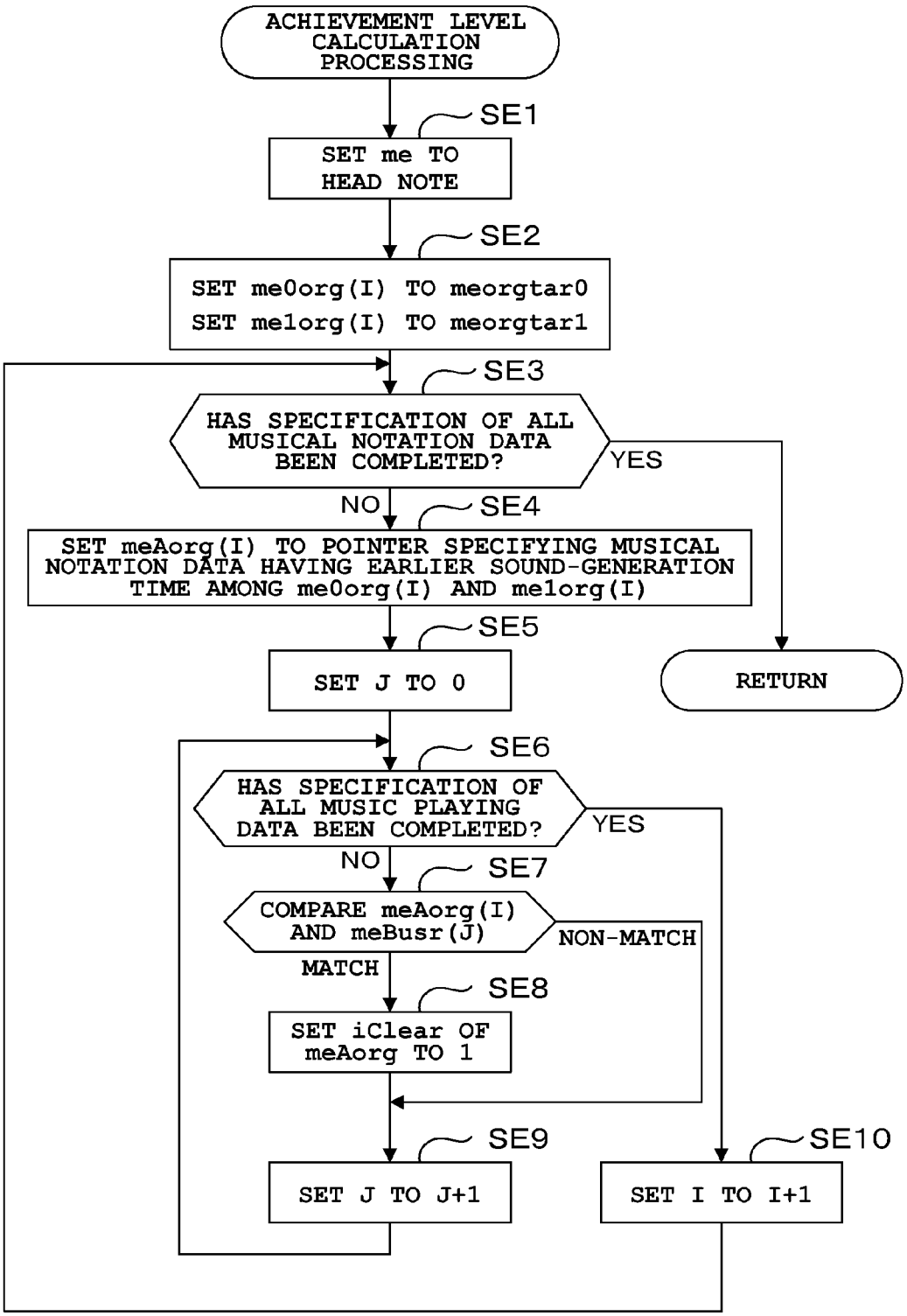
FIG. 7 is a flowchart of operations in musical performance judgment processing.

Next, operations in the musical performance judgment processing will be described with reference to FIG. 7. When the musical performance judgment processing is started at Step SA5 (see FIG. 2) of the main routine, the CPU 13 proceeds to Step SE1 in FIG. 7 and sets the pointer I that specifies musical notation data to an initial value "0".

Next, at Step SE2, the CPU 13 sets in the pointer me0org(I) the value of the pointer meorgtar0 that specifies musical notation data corresponding to music playing data generated by the playing and inputting of music by the user, from among the musical notation data of the right-hand part in the song data. In addition, the CPU 13 sets in the pointer me1org(I) the value of the pointer meorgtar1 that specifies musical notation data corresponding to music playing data generated by the playing and inputting of music by the user, from among the musical notation data of the left-hand part in the song data.

Then, at Step SE3, the CPU 13 judges whether or not all the musical notation data have been specified based on the forwarding of the pointer I. When judged that not all of the musical notation data have been specified, the judgment result at Step SE3 is "NO", and therefore the CPU 13 proceeds to Step SE4. At Step SE4, the CPU 13 compares the sound-generation time iTime of musical notation data specified by the pointer me0org(I) with the sound-generation time iTime of musical notation data specified by the pointer me1org(I), and sets the pointer meAorg(I) to a pointer specifying musical notation data having an earlier sound-generation time.

Then, at Step SE5, the CPU 13 sets the pointer "J" that specifies music playing data to the initial value "0". Next, at Step SE6, the CPU 13 judges whether or not all the music playing data have been specified based on the forwarding of the pointer J. When judged that not all of the music playing data have been specified, the judgment result at Step SE6 is "NO" and therefore the CPU 13 proceeds to Step SE7. At Step SE7, the CPU 13 compares the pitch iPit of the musical notation data specified by the pointer meAorg(I) with the pitch of music playing data specified by the pointer meBusr (J).

When judged that the pitch of the musical notation data and the pitch of the music playing data match, the CPU 13 proceeds to Step SE8. At Step SE8, the CPU 13 sets a clear flag iClear of the musical notation data specified by the pointer meAorg(I) to "1", and thereby indicates that the sound is correctly played. Then, the CPU 13 proceeds to Step SE9, and after incrementing and forwarding the pointer J, returns to above-described Step SE6. Hereafter, the CPU 13 repeats above-described Step SE6 to Step SE9 while forwarding the pointer 3.

Then, when all the music playing data are specified by the forwarding of the pointer J, the judgment result at Step SE6 is "YES" and therefore the CPU 13 proceeds to Step SE10. At Step SE10, the CPU 13 increments and forwards the pointer I, and then returns to above-described Step SE3. When all the musical notation data are specified by the forwarding of the pointer I, the judgment result at Step SE3 is "YES" and therefore the CPU 13 ends the musical performance judgment processing.

(6) Operations in the Achievement Level Calculation Processing

Figure 8:
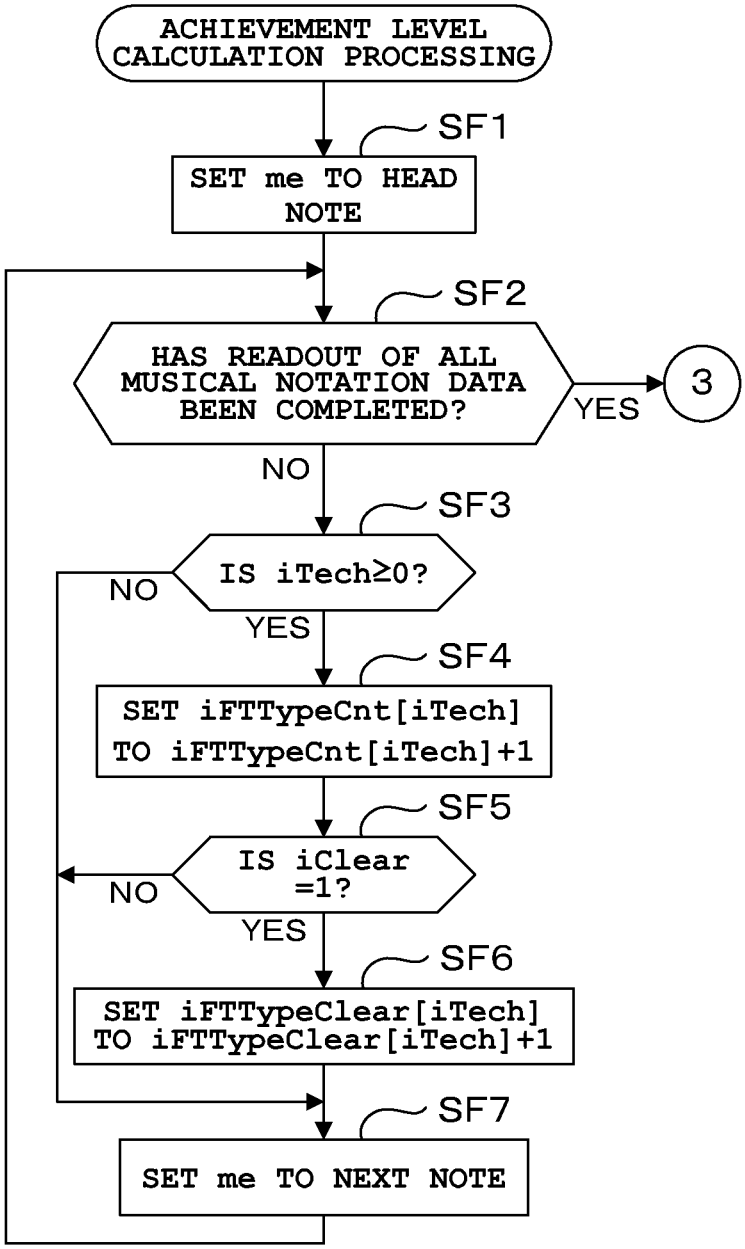
FIG. 8 is a flowchart of operations in achievement level calculation processing.

Next, operations in the achievement level calculation processing will be described with reference to FIG. 8 to FIG. 9. When the achievement level calculation processing is started at Step SA6 (see FIG. 2) of the main routine, the CPU 13 proceeds to Step SF1 in FIG. 8 and stores the musical notation data of the head note (first sound of song) in a register "me". Next, at Step SF2, the CPU 13 judges whether or not all the musical notation data in the song data have been read out. When judged that not all of the musical notation data have been read out, the judgment result at Step SF2 is "NO" and therefore the CPU 13 proceeds to Step SF3.

At Step SF3, the CPU 13 judges whether or not the musical performance technique type iTech included in the musical notation data stored in the register "me" is "0" or more, or in other words, a note requiring musical performance technique. When the musical performance technique type iTech is a negative value, the note does not require musical performance technique. Accordingly, the judgment result is "NO" and therefore the CPU 17 proceeds to Step SF7. At Step SF7, the CPU 13 stores the next musical notation data in the register "me", and then returns to above-described Step SF2.

On the other hand, when the musical performance technique type iTech included in the musical notation data stored in the register "me" is "0" or more and the type of musical performance technique is indicated, the judgment result at Step SF3 is "YES" and therefore the CPU 13 proceeds to Step SF4. At Step SF4, the CPU 13 increments and advances a counter iFTTypeCnt[iTech] that counts the number of occurrences for each musical performance technique type iTech.

Next, at Step SF5, the CPU 13 judges whether or not the clear flag iClear included in the musical notation data stored in the register "me" is "1", or in other words, whether or not the note has been correctly played. When the note has not been correctly played (the clear flag iClear is "0"), the judgment result at Step SF5 is "NO" and therefore the CPU 13 proceeds to Step SF7. At Step SF7, the CPU 13 stores the next musical, notation data in the register and then returns to above-described Step SF2.

Conversely, when the note has been correctly played, the judgment result at Step SF5 is "YES" and therefore the CPU 13 proceeds to Step SF6. At Step SF6, the CPU 13 increments and advances a counter iFTTypeClear[iTech] that counts the number of times cleared for each musical performance technique type iTech. Then, the CPU 13 proceeds to Step SF7, and after storing the next musical notation data in the register "me", returns to above-described Step SF2.

Hereafter, until all the musical notation data are read out, the CPU 13 repeats above-described Step SF2 to Step SF7, whereby the number of occurrences for each musical performance technique type iTech is counted by the counter iFTTypeCnt[iTech] and the number of times cleared for each musical performance technique type iTech is counted by the counter iFTTypeClear[iTech].

Figure 9:
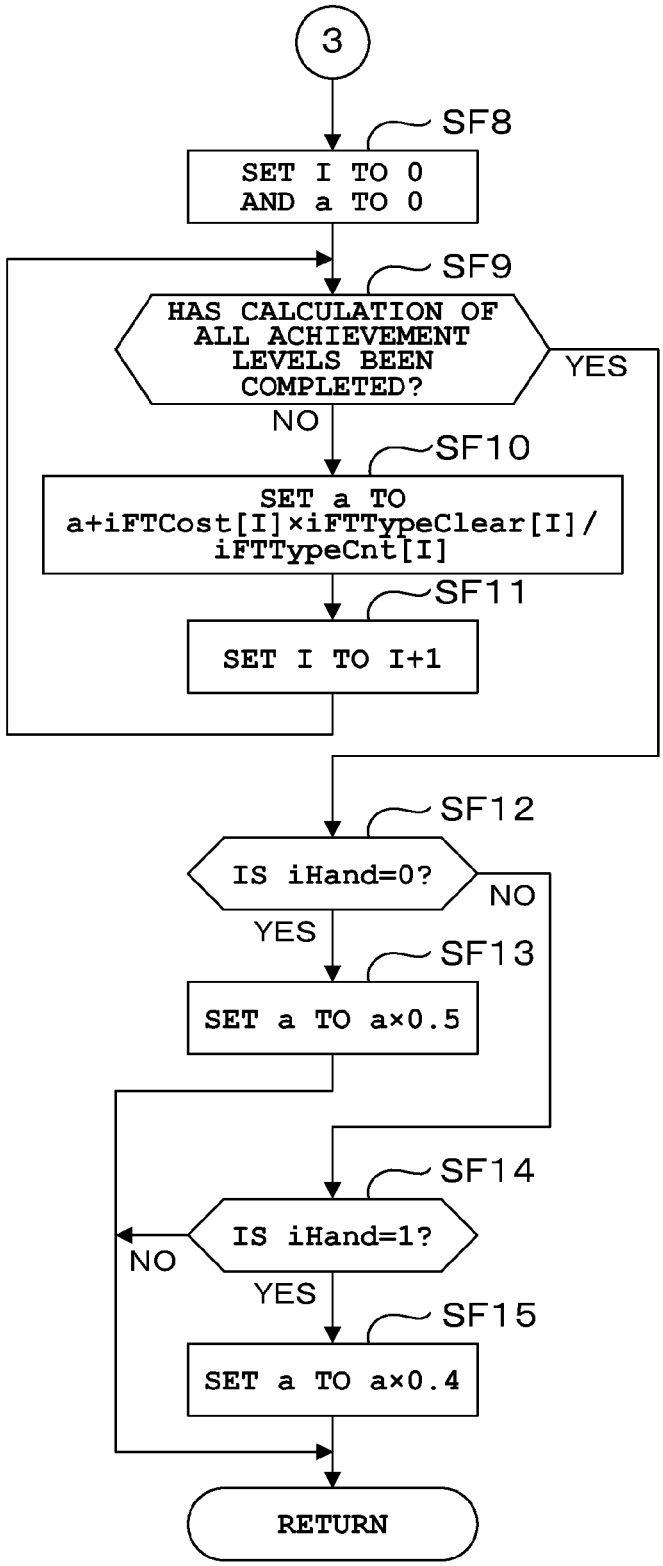
FIG. 9 is a flowchart of operations in the achievement level calculation processing following those in FIG. 8.

When all the musical notation data are read out, the judgment result at Step SF2 is "YES" and therefore the CPU 13 proceeds to Step SF8 in FIG. 9. At Step SF8, the CPU 13 clears the pointer I that specifies the type of musical performance technique and a register "a." to "0". Note that the register "a" herein stores an achievement level indicating improvement in playing skills as described later, which is hereinafter referred to as achievement level "a".

Next, at Step SF9, the CPU 13 judges whether or not the calculation of an achievement level "a" for each type of musical performance technique has been completed. When the calculation has not been completed, the judgment result at Step SF9 is "NO" and therefore the CPU 13 proceeds to Step SF10. At Step SF10 to Step SF11, the CPU 13 calculates the achievement level "a" for the type of musical performance technique specified by the pointer I by multiplying an accuracy rate, which is acquired by dividing the number of times cleared (counter iFTTypeClear[I]) by the number of occurrences (counter iFTTypeClear [I]), with a difficulty level that is read out from the difficulty level table iFTCost in accordance with the pointer I, and accumulates it along with the forwarding of the pointer I.

At above-described Step SF10, when the achievement level "a" is calculated for all the musical performance technique types, the achievement levels "a" calculated for each musical performance technique type are accumulated. As a result, the CPU 13 acquires an achievement level "a" that takes into account the difficulty level of the song played and inputted by the user. In addition, when the achievement levels "a" for all the musical performance technique types are calculated, the judgment result at Step SF9 is "YES" and therefore the CPU 13 proceeds to Step SF12.

At Step SF12, the CPU 13 judges whether or not the part specification data iHand is "0", or in other words, whether or not the right-hand part has been played and inputted. When judged that the right-hand part has been played and inputted, the judgment result at Step SF12 is "YES" and therefore the CPU 13 proceeds to Step SF17. At Step SF17, the CPU 13 calculates the achievement level "a." for the playing and inputting of the right-hand part by multiplying the achievement level "a" acquired at above-described Step SF10 with a correction value "0.5", and then completes the achievement level calculation processing.

Conversely, when judged that the right-hand part has not been played and inputted, the judgment result at Step SF12 is "NO" and therefore the CPU 13 proceeds to Step SF14. At Step SF14, the CPU 13 judges whether or not the part specification data iHand is "1", or in other words whether or not the left-hand part has been played and inputted. When judged that the left-hand part has been played and inputted, the judgment result at Step SF12 is "YES" and therefore the CPU 13 proceeds to Step SF15. At Step SF15, the CPU 13 calculates the achievement level "a" for the playing and inputting of the left-hand part by multiplying the achievement level acquired at above-described Step SF10 with a correction value "0.4", and then completes the achievement level calculation processing. When judged that the left-hand and right-hand part has been played and inputted, the judgment results at Step SF12 and Step SF14 are "NO", in this case, the CPU 13 sets the achievement level "a" acquired at above-described Step SF10 directly as the achievement level "a" for the playing and inputting of the left- and right-hand part, and then completes the achievement level calculation processing.

As described above, the present embodiment identifies musical notation data in song data serving as a model (model performance) to which music playing data generated by the song being played and inputted by the user corresponds; determines whether the musical notation data is played by the right-hand, the left-hand, or both hands; judges whether or not the note of the musical notation data has been correctly played by comparing the pitch iPit of the identified musical notation data with the pitch of the music playing data; and set the clear flag iClear of the correctly played musical notation data to "1".

Then, the present embodiment extracts the number of occurrences and the number of times cleared (the number of times the musical notation data is correctly played) for each type of musical performance technique from the musical performance technique type iTech included in all musical notation data in the song data; calculates an achievement level for each type of musical performance technique by multiplying an accuracy rate (number of times cleared/number of occurrences) for each type of musical performance technique acquired from the extracted number of occurrences and the extracted number of times cleared by a difficulty level according to the type of musical performance technique; accumulates each calculated achievement level; and thereby acquires an achievement level "a" based on the difficulty level of the song. Therefore, achievement levels indicating the degree of improvement in the user's playing skills can be evaluated taking into consideration the difficulty of the song.

In addition, the above-described embodiment uses DP matching to identify musical notation data in song data serving as a model (model performance) to which music playing data generated by the song being played and inputted by the user corresponds and to determine whether the musical notation data is played by the right-hand, the left-hand, or both hands. Therefore, regardless of which sound in song data is played, musical notation data corresponding music playing data can be identified.

In the configuration of the present embodiment, achievement levels for the playing and inputting of a right-hand part and a left-hand part are acquired by multiplying the achievement level "a" based on the difficulty of the song, which is acquired by the accumulation of achievement levels for each musical performance technique type, by a fixed correction coefficient. However, the present invention is not limited thereto, and a configuration may be adopted in which this correction coefficient is varied depending on the difficulty of a played and inputted song segment (for example, in bar units). Alternatively, a configuration may be adopted in which a correction coefficient for each part differs depending on whether the user is right-handed or left-handed.

While the present invention has been described with reference to the preferred embodiments, it is intended that the invention be not limited by any of the details of the description therein but includes all the embodiments which fall within the scope of the appended claims.

What is claimed is:

1. A musical performance evaluating device comprising:

a memory which stores a plurality of musical notation data that respectively express each note constituting a song and include a musical performance technique type and an identification flag;

an identifying section which identifies musical notation data of a note corresponding to music playing data played and inputted, from the plurality of musical notation data stored in the memory;

a flag setting section which sets the identification flag in the identified musical notation data to a flag value indicating that the note has been correctly played, when a pitch of the identified musical notation data of the note and a pitch of the music playing data match;

an accuracy rate calculating section which calculates an accuracy rate for each musical performance, technique type from number of occurrences and number of times a note has been correctly played for each musical performance technique type which are extracted based on the musical performance technique type and the identification flag included in each of the plurality of musical notation data stored in the memory; and an achievement level acquiring section which acquires an achievement level based on a difficulty level of the song by accumulating achievement levels for each musical performance technique type which are acquired based on the calculated accuracy rate for each musical performance technique type and a difficulty level according to the musical performance technique type.

2. The musical performance evaluating device according to claim 1, wherein the identifying section calculates a distance equivalent to degree of similarity for the music playing data played and inputted, by performing DP matching on all of the plurality of musical notation data stored in the memory, and identifies musical notation data which has a shortest distance among calculated distances and accordingly has a greatest degree of similarity, as a note corresponding to the music playing data.

3. The musical performance evaluating device according to claim 1, wherein the identifying section identifies whether the musical notation data of the note corresponding to the music playing data played and inputted is a right-hand part, a left-hand part, or a left-hand and right-hand part, when the plurality of musical notation data stored in the memory have been divided into the right-hand part, the left-hand part, and the left-hand and right-hand part.

4. The musical performance evaluating device according to claim 1, wherein the achievement level acquiring section further includes an achievement level correcting section that calculates achievement levels of a right-hand part and a left-hand part by multiplying the achievement level based on the difficulty level of the song by differing correction coefficients.

5. A non-transitory computer readable storage medium having stored thereon a program that is executable by a computer mounted in a musical performance evaluating device, the program being executable by the computer to perform functions comprising;

identification processing for identifying musical notation data of a note corresponding to music playing data played and inputted, from a plurality of musical notation data that respectively express each note constituting a song and include a musical performance technique type and an identification flag;

flag setting processing for setting the identification flag in the identified musical notation data to a flag value indicating that the note has been correctly played, when a pitch of the identified musical notation data of the note and a pitch of the music playing data match;

accuracy rate calculation processing for calculating an accuracy rate for each musical performance technique type from number of occurrences and number of times a note has been correctly played for each musical performance technique type which are extracted based on the musical performance technique type and the identification flag included in each of the plurality of musical notation data; and achievement level acquisition processing for acquiring an achievement level based on a difficulty level of the song by accumulating achievement levels for each musical performance technique type which are acquired based on the calculated accuracy rate for each musical performance technique type and a difficulty level according to the musical performance technique type.

6. A musical performance evaluating method performed by a musical performance evaluating device including a memory which stores a plurality of musical notation data that respectively express each note constituting a song and include a musical performance technique type and an identification flag, comprising:

an identifying step of identifying musical notation data of a note corresponding to music playing data played and inputted, from the plurality of musical notation data stored in the memory;

a flag setting step of setting the identification flag in the identified musical notation data to a flag value indicating that the note has been correctly played, when a pitch of the identified musical notation data of the note and a pitch of the music playing data match;

an accuracy rate calculating step of calculating an accuracy rate for each musical performance technique type from number of occurrences and number of times a note has been correctly played for each musical performance technique type which are extracted based on the musical performance technique type and the identification flag included in each of the plurality of musical notation data stored in the memory; and an achievement level acquiring step of acquiring an achievement level based on a difficulty level of the song by accumulating achievement levels for each musical performance technique type which are acquired based on the calculated accuracy rate for each musical performance technique type and a difficulty level according to the musical performance technique type.

* * * * *